United States Patent [19]

Klutz, Jr. et al.

[11] Patent Number: 4,504,407

[45] Date of Patent: Mar. 12, 1986

[54] DRY SPOT REMOVER COMPOSITION AND CONTAINER COMPRISING WHITE TALC AND EUCALYPTUS OIL

[76] Inventors: Nathaniel Klutz, Jr., c/o George Spector, 3615 Woolworth Bldg., 233 Broadway; George Spector, 3615 Woolworth Bldg., 233 Broadway, both of New York, N.Y. 10007

[21] Appl. No.: 526,785

[22] Filed: Aug. 26, 1983

[51] Int. Cl.[3] ..... C11D 7/60; B08B 1/00; B65D 25/08

[52] U.S. Cl. ..... 252/162; 206/219; 252/88; 252/91; 252/155; 252/163; 252/174.25

[58] Field of Search ..... 252/163, 155, 91, 174.25, 252/88, 162; 206/219

[56] References Cited

U.S. PATENT DOCUMENTS

| | | | |
|---|---|---|---|
| 788,042 | 4/1905 | Getz | 252/88 |
| 2,364,608 | 12/1944 | Edwards | 252/88 |
| 2,692,861 | 10/1954 | Weeks | 252/88 |
| 3,736,259 | 5/1973 | Buck et al. | 252/174.25 |
| 3,775,052 | 11/1973 | Van Paassen | 252/88 |
| 3,909,461 | 9/1975 | Culmone et al. | 252/163 |
| 4,372,867 | 2/1983 | Targos | 252/91 |
| 4,395,347 | 7/1983 | McLaughlin et al. | 252/174.25 |

FOREIGN PATENT DOCUMENTS

| | | | |
|---|---|---|---|
| 0062536 | 10/1982 | European Pat. Off. | 252/88 |

*Primary Examiner*—John E. Kittle
*Assistant Examiner*—Mukund J. Shah

[57] ABSTRACT

A liquid detergent and spot remover composition for cleaning carpets, rugs and upholstered furniture, a dry powder spot remover composition and an applicator kit especially designed for these compositions is provided and consists of an applicator for the liquid detergent and spot remover, a container especially adapted for mixing the dry powder spot remover and a display box having a cover that opens.

2 Claims, 5 Drawing Figures

DRY SPOT REMOVER COMPOSITION AND CONTAINER COMPRISING WHITE TALC AND EUCALYPTUS OIL

BACKGROUND OF THE INVENTION

The instant invention relates generally to detergent compositions and more specifically it relates to a liquid detergent and spot remover composition for cleaning carpets, rugs and upholstered furniture, a dry powder spot remover composition and an applicator kit especially designed for these compositions.

Numerous detergent compositions have been provided in prior art that are adapted to clean fabric. For example U.S. Pat. Nos. 3,320,172; 4,137,197 and 4,277,378 all are illustrative of such prior art. While these units may be suitable for the particular purpose to which they address, they would not be suitable for the purposes of the present invention as heretofore described.

SUMMARY OF THE INVENTION

A principle object of the present invention is to provide a liquid detergent and spot remover composition for cleaning carpets, rugs and upholstered furniture.

Another object is to provide a dry powder spot remover composition that will penetrate and absorb the spot leaving no ring.

An additional object is to provide an applicator especially adapted for the liquid detergent and spot remover composition that will apply the composition onto a spot.

A further object is to provide a container especially adapted for mixing the dry powder spot remover composition so that the composition can be sprinkled onto a spot.

A still further object is to provide an applicator kit especially adapted for holding the applicator and the container that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
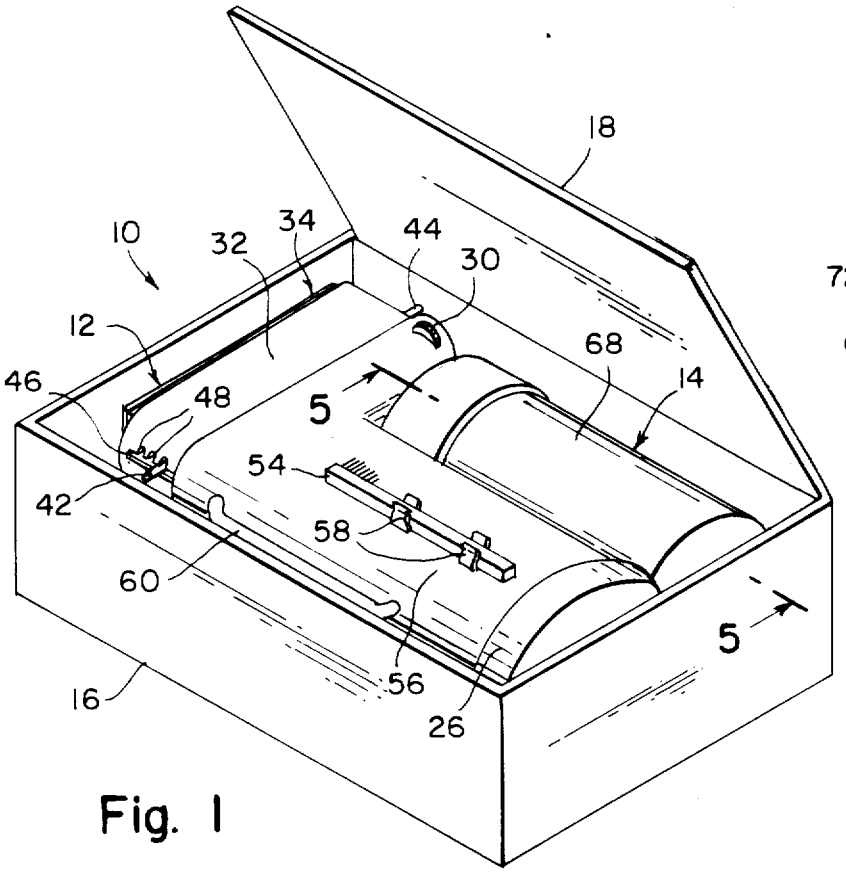
FIG. 1 is a perspective view of a complete household cleaning kit utilizing the invention.

Turning now descriptively to the drawings, in which similar reference characters denote similar elements throughout the several views, FIG. 1 illustrates an applicator kit 10 especially adapted for holding an applicator 12 and a container 14. The kit 10 consists of a display box 16 having a cover 18 that opens so that the applicator 12 and the container 14 can be removed therefrom.

The applicator 12 is especially adapted for a liquid detergent and spot remover composition (not shown) for cleaning carpets, rugs and upholstered furniture. The composition consists of 8 ounces of santomerse No. 3 paste or duponol M.E. 8 ounces of butyl cellosolve or butyl alcohol, 32 ounces of perchlorothlene, 6 grams of acetic acid, 56% and 80 ounces of naptha.

Figure 2:
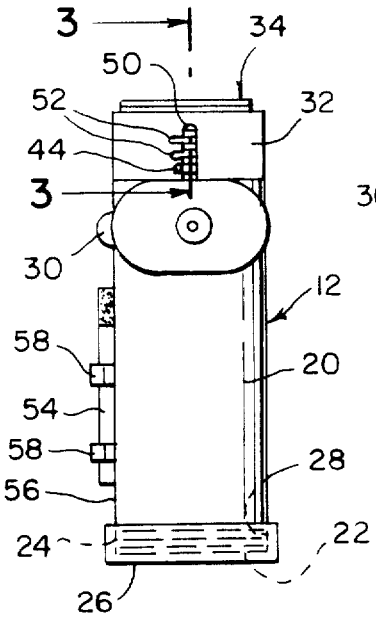
FIG. 2 is a front view of the liquid detergent container.

The applicator 12 as shown in FIGS. 1 and 2 consists of a housing 20 having an open bottom aperture 22 with external threads 24 to contain the composition. A cap 26 is provided having internal threads 28 to engage the external threads 24 at the bottom aperture 22 of the housing 20. A device 30, such as a rotary valve with external knob, is for applying the composition within the housing 20 onto a spot.

Figure 3:
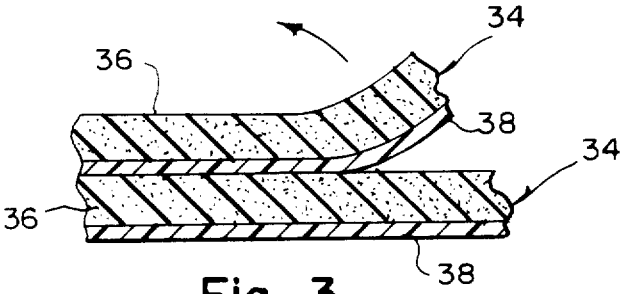
FIG. 3 is an enlarged cross sectional view taken along line 3—3 in FIG. 2 showing absorbent laminated pads, which can be mounted at the top of the container.
Figure 4:
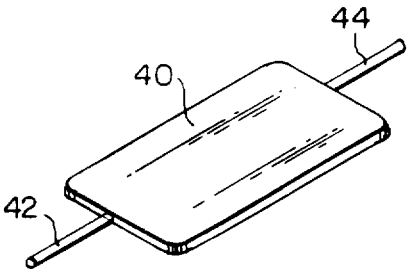
FIG. 4 is a perspective view of a pad dispenser plate used in the liquid detergent container to raise the laminated pads for use in blotting the liquid detergent.

The applicator 12 further contains a device 32 for applying absorbent laminated pads 34 to the spot. The pads 34 as best shown in FIG. 3 consists of absorbent material 36, such as sponge, and non absorbent material 38, such as plastic linings. Each pad 34 can be pealed off, as shown, so that the next pad can be used. The device 32 has a plate 40 with two opposite arms 42 and 44 as best seen in FIG. 4. Arm 42 fits into a slot 46 having notches 48 while arm 44 fits into slot 50 having notches 52. When the pads 34 are pealed off the arms 42 and 44 can move up the slots 46 and 50 into the next notch 48 and 52 so that the plate 40 will push up the pads 34.

The applicator 12 has a small stiff bristle brush 54 that is removably mounted to side 56 by a pair of clamps 58. A handle 60 can also be provided so that a person can hold the applicator 12 easily.

The container 14 is especially adapted for mixing a dry powder spot remover composition 62. The composition 62 consists of 2 pounds of light white talc (steatite) 64 and 1 ounce of eucalyptus oil 66.

Figure 5:
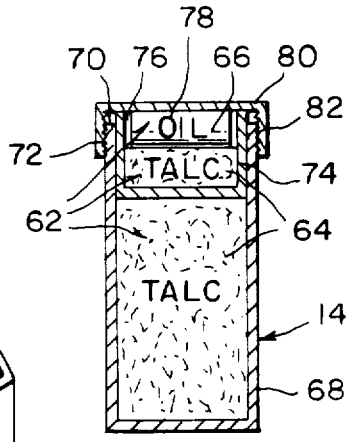
FIG. 5 is a cross sectional view taken along line 5—5 in FIG. 1 showing in greater detail a dry powder spot remover container housing smaller containers for oil and talc used for mixing purposes.

The container 14 as shown in FIGS. 1 and 5 consists of a large housing 68 having an open top aperture 70 with external threads 72 to contain a large portion of the talc 64. A small housing 74 is also provided and hasan open top aperture 76 to contain a small portion of the talc 64. A can 78 of the eucalyptus oil 66 is placed within the small housing 74 with the small housing 74 placed within the large housing 68. A cap 80 has internal threads 82 to engage the external threads 72 at the top aperture 70 of the large housing 68.

When the cap 80 is removed from the large housing 68 the eucalyptus oil can 78 will be removed, opened and poured into the small housing 74 being throughly mixed with the talc 64. The small housing 74 will then be removed from the large housing 68 and the mixture placed into the balance of the talc 64 in the large housing 68 and mixed very well.

The santomerse No. 3 paste is available from Monsanto Chemical Co., 800 N. Lindbergh Blvd., St. Louis, MO 63166. All the other chemicals used in these compositions should be readily available from most chemical supply sources.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A dry powder spot remover composition comprising:

(a) 2 pounds of light white talc (steatite); and (b) 1 ounce of eucalyptus oil.

2. A container especially adapted for mixing the composition recited in claim 1 comprising:

(a) a large housing having an open top aperture with external threads to contain a large portion of the talc;

(b) a small housing having an open top aperture to contain a small portion of the talc;

(c) a can of the eucalyptus oil placed within the small housing with the small housing placed within the large housing; and (d) a cap having internal threads to engage the external threads at the top aperture of the large housing so that when the cap is removed from the large housing the eucalyptus oil can be removed, opened and poured into the small housing being throughly mixed with the talc, the small housing will then be removed from the large housing and the mixture placed into balance of the talc in the large housing and mixed very well.

* * * * *